US009035212B2

(12) United States Patent
Liljestrand et al.

(10) Patent No.: US 9,035,212 B2
(45) Date of Patent: May 19, 2015

(54) SWITCH HAVING TWO SETS OF CONTACT ELEMENTS

(75) Inventors: Lars Liljestrand, Västerås (SE); Lars E. Jonsson, Västerås (SE); Per Skarby, Würenlos (CH); Per Lindholm, Stockholm (SE); Ueli Steiger, Zürich (CH)

(73) Assignee: ABB TECHNOLOGY AG, Zürich (CH)

( * ) Notice: Subject to any disclaimer, the term of this patent is extended or adjusted under 35 U.S.C. 154(b) by 419 days.

(21) Appl. No.: 13/444,402

(22) Filed: Apr. 11, 2012

(65) Prior Publication Data

US 2013/0098874 A1 Apr. 25, 2013

(30) Foreign Application Priority Data

Apr. 11, 2011 (EP) ..... 11161921

(51) Int. Cl.
*H01H 33/14* (2006.01)
*H01H 33/22* (2006.01)
(Continued)

(52) U.S. Cl.
CPC ..... *H01H 33/22* (2013.01); *H01H 1/50* (2013.01); *H01H 33/14* (2013.01); *H01H 33/64* (2013.01); *H01H 33/68* (2013.01); *H01H 2033/566* (2013.01)

(58) Field of Classification Search
CPC ..... H01H 33/14; H01H 33/22; H01H 67/02
USPC ..... 218/7, 13, 14, 90, 92, 153, 154; 200/239–243, 272, 274; 335/71, 72, 335/75, 97, 106, 107, 184–186, 192, 195, 335/201, 202
See application file for complete search history.

(56) References Cited

U.S. PATENT DOCUMENTS 1,918,732 A 7/1933 Adams
2,833,996 A * 5/1958 Whicker et al. ..... 439/12
(Continued)

FOREIGN PATENT DOCUMENTS

FR 2 662 300 A1 11/1991
WO WO 2010/037424 A1 4/2010
WO WO 2010/142346 A1 12/2010

OTHER PUBLICATIONS

Office Action issued by the U.S. Patent and Trademark Office in the U.S. Appl. No. 13/444,625, mailed Apr. 1, 2013, U.S. Patent and Trademark Office, Alexandria, VA. (10 pages).
(Continued)

*Primary Examiner* — Amy Cohen Johnson
*Assistant Examiner* — Marina Fishman
(74) *Attorney, Agent, or Firm* — Buchanan Ingersoll & Rooney PC

(57) ABSTRACT

An exemplary medium or high voltage switch has a first set of contact elements and a second set of contact elements. Each contact element includes an insulating carrier carrying conducting elements. In the closed state of the switch, the conducting elements align to form one or more current paths between terminals of the switch along an axial direction. For opening the switch, the contact elements are mutually displaced by means of one or two drives along a direction perpendicular to the axial direction. The switching arrangement is arranged in a fluid-tight housing in a gas of elevated pressure or in a liquid. The switch has a high voltage withstand capability and fast switching times.

25 Claims, 4 Drawing Sheets

(51) Int. Cl.

| | |
|---|---|
| *H01H 1/50* | (2006.01) |
| *H01H 33/64* | (2006.01) |
| *H01H 33/68* | (2006.01) |
| *H01H 33/56* | (2006.01) |

(56) References Cited

U.S. PATENT DOCUMENTS

| | | | | |
|---|---|---|---|---|
| 2,894,095 | A | 7/1959 | Ludvig | |
| 3,246,101 | A | 4/1966 | Caputo | |
| 3,310,640 | A | 3/1967 | Alexander | |
| 3,378,796 | A | 4/1968 | Caputo | |
| 3,430,062 | A | 2/1969 | Roth | |
| 4,105,879 | A | 8/1978 | Tsukushi et al. | |
| 4,529,953 | A | 7/1985 | Myers | |
| 5,851,120 | A * | 12/1998 | Sobhani | 439/17 |
| 7,235,751 | B2 | 6/2007 | Liljestrand et al. | |
| 8,680,421 | B2 * | 3/2014 | Hyrenbach et al. | 218/158 |
| 2004/0245857 | A1 | 12/2004 | Liljestrand et al. | |
| 2012/0145521 | A1 * | 6/2012 | Glasmacher | 200/293 |
| 2013/0015930 | A1 | 1/2013 | Jonsson | |

OTHER PUBLICATIONS

European Search Report (EPO Form 1507N) dated Sep. 9, 2011.
European Search Report (EPO Form 1507N) dated Sep. 16, 2011.

* cited by examiner

SWITCH HAVING TWO SETS OF CONTACT ELEMENTS

RELATED APPLICATION

This application claims priority under 35 U.S.C. §119 to European Application EP 11161921.9 filed in Europe on Apr. 11, 2011. The content of which is hereby incorporated by reference in its entirety.

FIELD

The disclosure relates to a high or medium voltage switch including a first and a second set of contact elements that are mutually displaceable. The disclosure also relates to a current breaker including such a switch.

BACKGROUND INFORMATION

The present disclosure relates to a first and a second set of contact elements and a drive adapted to mutually displace the contact elements along a displacement direction. Each contact element carries at least one conducting element. In a first mutual position of the contact elements, their conducting elements combine to form at least one conducting path between the first and second terminals of the switch, in a direction transversally to the displacement direction. In a second position of the contact elements, the conducting elements are mutually displaced into staggered positions and therefore the above conducting path is interrupted.

When the switch of U.S. Pat. No. 7,235,751 in opened, i.e. when the current is to be switched off, arcs form between the conducting elements that are being separated. These arcs can be cooled quickly because they are in direct contact with the solid material of the contact elements instead of being in contact with a surrounding gas. This results in a high arc voltage with favourable current commutating properties.

SUMMARY

An exemplary high or medium voltage switch is disclosed comprising: a first and a second terminal; a first and a second set of contact elements arranged between the first and the second terminal; and at least a first drive adapted to mutually displace the sets of contact elements along a displacement direction, wherein each contact element comprises an insulating carrier carrying at least one conducting element, wherein in a first mutual position of said contact elements the at least one conducting element of each contact element forms at least one conducting path in an axial direction between said first and said second terminals in a direction transversally to said displacement direction, and wherein in a second mutual position of said contact elements the at least one conducting element of each contact element are mutually displaced and do not form said conducting path, and wherein said first and second contact elements are encapsulated in a fluid-tight housing and wherein said fluid-tight housing includes an electrically insulating fluid surrounding said contact elements.

An exemplary current breaker is disclosed, including a switch including a first and a second terminal, a first and a second set of contact elements arranged between the first and the second terminal, and at least a first drive adapted to mutually displace the sets of contact elements along a displacement direction, wherein each contact element comprises an insulating carrier carrying at least one conducting element, wherein in a first mutual position of said contact elements the at least one conducting element of each contact element forms at least one conducting path in an axial direction between said first and said second terminals in a direction transversally to said displacement direction, and wherein in a second mutual position of said contact elements the at least one conducting element of each contact element are mutually displaced and do not form said conducting path, and wherein said first and second contact elements are encapsulated in a fluid-tight housing and wherein said fluid-tight housing includes an electrically insulating fluid surrounding said contact elements, said current breaker comprising: a primary electrical branch and a secondary electrical branch in parallel; at least one solid state breaker arranged in the primary electrical branch; and a plurality of solid state breakers arranged in series in the secondary electrical branch, wherein a number of solid state breakers in the secondary electrical branch is larger than a number of solid state breakers in the primary electrical branch, and wherein said switch is arranged in said primary electrical branch in series to said solid state breaker of said electrical primary branch.

BRIEF DESCRIPTION OF THE DRAWINGS

The disclosure will be better understood and objects, advantages and embodiments other than those set forth above will become apparent from the following detailed description thereof. Such description makes reference to the annexed drawings, wherein.

DETAILED DESCRIPTION

Figure 1:
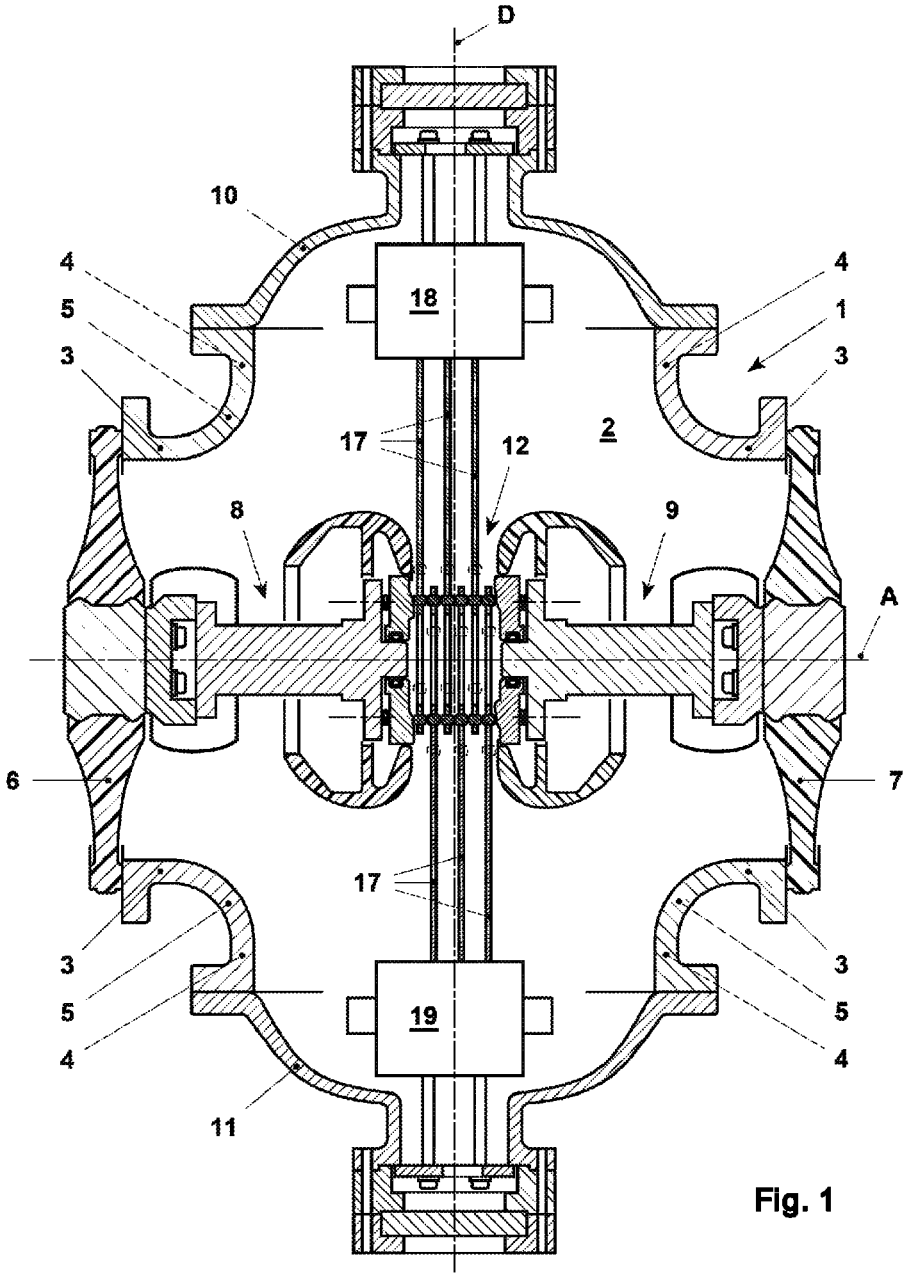
FIG. 1 shows a cross-sectional view of a switch in accordance with an exemplary embodiment.

Exemplary embodiments of the present disclosure are directed to a switch having a first and a second terminal for applying the current to be switched. Furthermore, it has a first and a second set of contact elements and a drive adapted to mutually displace the sets of contact elements relative to each other along a displacement direction. Each contact element includes an insulating carrier that carries at least one conducting element. The positions of the conducting elements are such that:

1) in a first mutual position of the contact elements the conducting elements form one or more conducting paths along an axial direction between the first and the second terminals, i.e. the switch is in the closed current-conducting position; and 2) in a second mutual position of the contact elements the conducting elements are mutually displaced such that the conducting path does not form, i.e. the switch is in its opened non-conducting position.

In an exemplary embodiment, at least the first and the second contact elements are further encapsulated in a fluid-tight housing, which contains an electrically insulating fluid surrounding the contact elements. Hence, in contrast to the teaching of U.S. Pat. No. 7,235,751, it is understood that the fluid surrounding the contact elements does plays a major role and the fluid should be a controlled, electrically insulating fluid. The fluid can be a gas and/or a liquid at a pressure equal to or different from the ambient atmospheric pressure. This measure allows to increase the dielectric strength of the switch, i.e. the voltage it is able to withstand in its opened state.

In another exemplary embodiment of the present disclosure, the fluid is a gas under a pressure exceeding 1 atm (approx. 101.325 kPa), for example, and more preferably exceeding 2 atm, in order to increase dielectric breakdown voltage. An exemplary gas can include $SF_6$ and/or air. Alternatively, the fluid may also include an oil. In another exemplary embodiment, the fluid may comprise a one-phase or possible two-phase dielectric medium, such as described in WO 2010/142346, e.g. fluoroketone, in particular C5 perfluoroketone and/or C6 perfluoroketone. WO 2010/142346 is herewith incorporated by reference in its entirety.

In an exemplary embodiment, each conducting element extends at least across the carrier carrying it. The extension of the conducting element along the axial direction exceeds the extension of the carrier in the axial direction. This ensures that, in the first position, the contacts abut against each other while the carriers do not, and that gaps are formed between the carriers. This provides a good mechanical contact between the contacts only and reduced frictional forces.

In addition, when a conducting element projects above the surface of the surrounding carrier, it can be shown that the electrical field at the intersection between the surface and the conducting element is smaller than for a device where the surface of the conducting element is substantially flush with the surface of the carrier. For that reason, the conducting element should project over the two opposite surfaces of the carrier that carries it.

Each conducting element can be slightly movable in axial direction in respect to the carrier that carries it and/or it is slightly tiltable around a tilt axis, wherein said tilt axis is perpendicular to the axial direction and to the direction of displacement. This allows the conducting element to axially position itself accurately when the switch is in its first, closed current-carrying position, thereby improving current conduction.

In yet another exemplary embodiment, each terminal forms a contact surface for contacting the conducting elements, wherein at least one of the terminals includes a spring member that elastically urges the contact surface of the terminal against the conducting elements. This arrangement can ensure a proper contacting force between the conducting elements themselves and between the conducting elements and the contact surfaces. This arrangement can be particularly advantageous in combination with conducting elements movable in axial direction since, in that case, the forces between all the conducting elements in a current path are substantially equal.

Another exemplary embodiment of the switch includes a second drive in addition to the first drive. The first drive is connected to the first set of contact elements and the second drive is connected to the second set of contact elements. Each drive is able to move its attributed set of contact elements, with said first and second drives being adapted to simultaneously, or at least in the same time window, move said first and second set, respectively, in opposite directions. By this measure, the relative contact separation speed can be doubled.

The drive or drives, if there is more than one, arranged within the housing, thus obviating the need for mechanical bushings.

The switch can be used in high voltage applications (i.e. for voltages above 72 kV), but it can also be used for medium voltage applications (between some kV and 72 kV).

FIG. 1 shows a cross-sectional view of a switch in accordance with an exemplary embodiment. The switch of FIG. 1 includes a fluid-tight housing 1 enclosing a space 2 filled with an insulating fluid, in particular SF6 and/or air and/or fluoroketone, in particular C5-perfluoroketone and/or C6-perfluoroketone, at elevated pressure, or an oil or two-phase dielectric medium, such as a fluoroketone, in particular a C5-perfluoroketone and/or a C6-perfluoroketone (at higher concentration, i.e. operated above the boiling point such that condensation occurs).

Housing 1 forms a GIS-type metallic enclosure of manifold type and includes two tube sections. A first tube section 3 extends along an axial direction A, and a second tube section 4 extends along a direction D, which is called the displacement direction for reasons that will become apparent below. Axial direction A is perpendicular or nearly perpendicular to displacement direction D. The tube sections are formed by a substantially cross-shaped housing section 5. Housing 1 can be at ground potential (e.g. in a GIS=gas-insulated substation), but it may also be on high voltage potential (e.g. in a life tank breaker).

First tube section 3 ends in first and second support insulators 6 and 7, respectively. First support insulator 6 carries a first terminal 8 and second support insulator 7 carries a second terminal 9 of the switch. The two terminals 8, 9 extending through the support insulators 6, 7 carry the current through the switch, substantially along axial direction A.

Second tube section 4 ends in a first and a second cap or flange 10 and 11, respectively.

First terminal 8 and second terminal 9 extend towards a center of space 2 and end at a distance from each other, with a switching arrangement 12 located between them, at the intersection region of first tube section 3 with second tube section 4.

Figure 2:
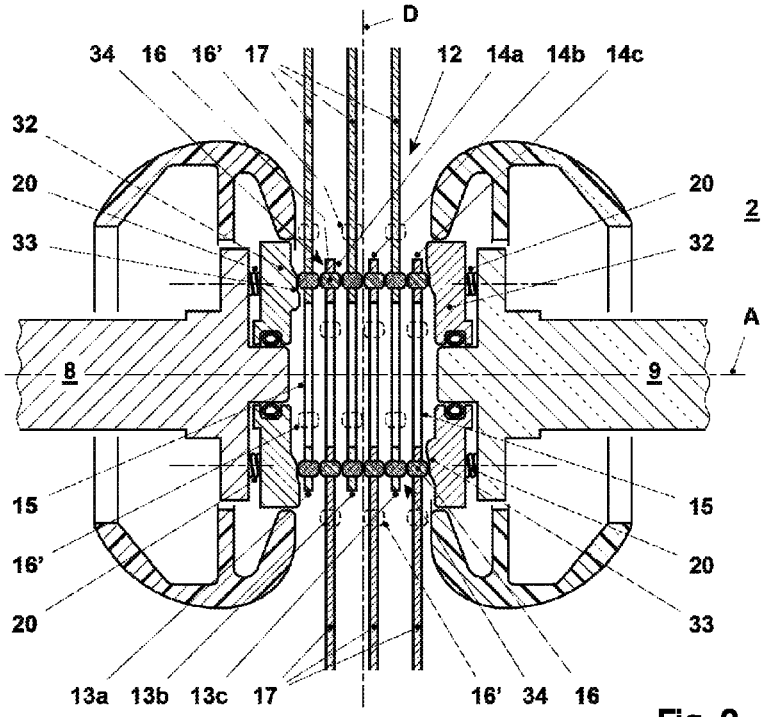
FIG. 2 shows an enlarged cross-sectional view of contact elements in accordance with an exemplary embodiment.

FIG. 2 shows an enlarged cross-sectional view of contact elements in accordance with an exemplary embodiment. As shown in FIG. 2, switching arrangement 12 includes a first set of contact elements 13*a*, 13*b*, 13*c* and a second set of contact elements 14*a*, 14*b*, 14*c*. In the exemplary embodiment shown here, each set includes three contact elements, but that number may vary, and, for example, be two or more than three. The first and second set may also have different numbers of contact elements, e.g. two and three, respectively. In an exemplary embodiment, the number is at least two contact elements per set. The contact elements of the two sets are stacked alternatingly, i.e. each contact element of one set is adjacent to two contact elements of the other set unless it is located at the end of switching arrangement 12, in which case it is located between one contact element of the other set and one of the terminals 8, 9.

Figure 7:
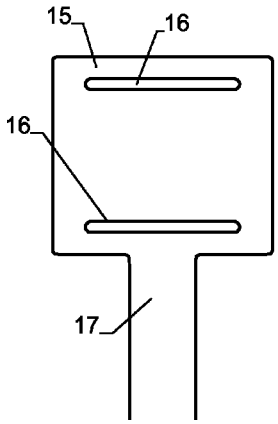
FIG. 7 shows a first arrangement of the conducting elements on the insulating carrier in accordance with an exemplary embodiment.

As shown in FIGS. 2 and 7, each contact element includes a plate-shaped insulating carrier 15, one or more conducting elements 16 and an actuator rod 17. In the exemplary embodiments of the present disclosure, each carrier 15 carries two conducting elements 16.

Figure 8:
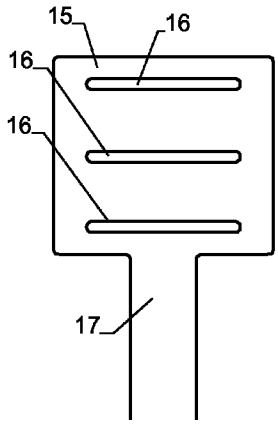
FIG. 8 shows a second arrangement of the conducting elements on the insulating carrier in accordance with an exemplary embodiment.
Figure 9:
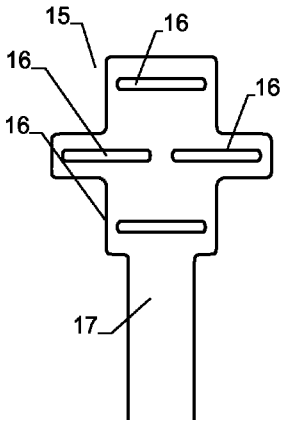
FIG. 9 shows a third arrangement of the conducting elements on the insulating carrier in accordance with an exemplary embodiment.

FIGS. 1 and 2 show the switch in the closed state with the contact elements 13*a*, 13*b*, 13*c*, 14*a*, 14*b*, 14*c* in a first mutual position, where the conducting elements 16 align to form two conducting paths 34 along axial direction A between the first and the second terminals 8, 9. The conducting paths 34 carry the current between the terminals 8, 9. Their number can be greater than one in order to increase continuous current carrying capability. FIG. 8 shows a second arrangement of the conducting elements on the insulating carrier in accordance with an exemplary embodiment. As shown in FIG. 8, an exemplary arrangement with three contact elements 16 in each insulating carrier 15, which leads to three conducting paths 34 when the switch is closed. FIG. 9 shows a third arrangement of the conducting elements on the insulating carrier in accordance with an exemplary embodiment. As shown in FIG. 9, an exemplary non-inline arrangement with four contact elements 16 in each insulating carrier 15, which leads to four conducting paths 34 when the switch is closed. In the above examples, each insulating carrier 15 had its own actuator rod 17. Alternatively, the number of actuator rods may be different, in particular smaller than the number of insulating carriers 15, with at least some of the insulating carriers being mechanically interconnected.

The contact elements 13*a*, 13*b*, 13*c*, 14*a*, 14*b*, 14*c* can be moved along the displacement direction D into a second position, where the conducting elements 16 are staggered in respect to each other and do not form a conducting path. In FIG. 2, the position of the conducting elements in this second position is shown in dotted lines under reference number 16'. As shown in FIG. 2, the conducting elements 16' are now separated from each other along direction D, thereby creating several contact gaps (two times the number of contact elements 13, 14), thereby quickly providing a high dielectric withstand level.

To achieve such a displacement, and as shown in FIG. 1, the actuator rods 17 are connected to two drives 18, 19. A first drive 18 is connected to the actuator rods 17 of the first set of contact elements 13*a*, 13*b*, 13*c*, and a second drive 19 is connected to the actuator rods 17 of the second set of contact elements 14*a*, 14*b*, 14*c*.

In the exemplary embodiment shown in FIGS. 1 and 2, the switch is opened by pulling the actuator rods 17 away from the center of the switch, thereby bringing the conducting elements into their second, staggered position. Alternatively, the rods 17 can be pushed towards the center of the switch, which also allows to bring the conducting elements into a staggered position.

The drives 18, 19 can e.g. operate on the repulsive Lorentz-force principle and be of the type disclosed in U.S. Pat. No. 7,235,751, which is herewith enclosed in its entirety by reference, and they are therefore not described in detail herein. Each drive is able to displace one set of contact elements along the displacement direction D. They are adapted and controlled to move the first and second sets in opposite directions at the same time, or at least in the same time window, in order to increase the travelling length and speed of displacement.

The drives 18, 19 are arranged in opposite end regions of second tube section 4.

Figure 6:
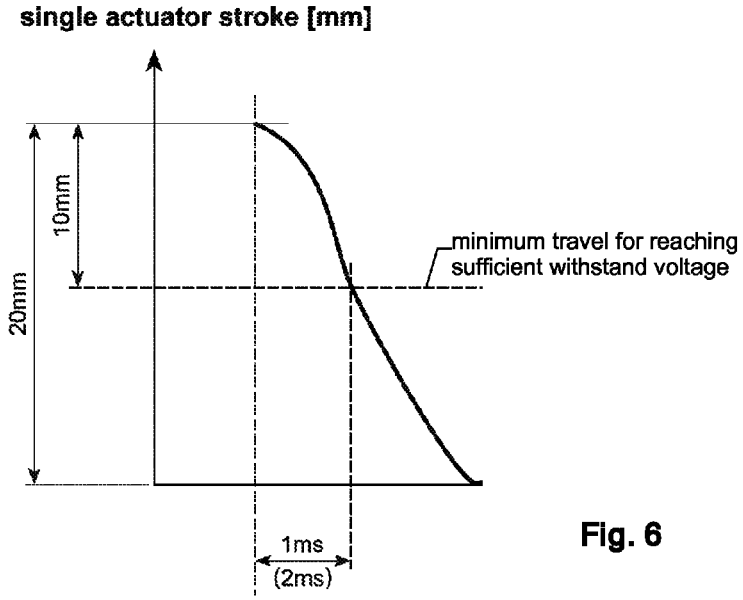
FIG. 6 shows a stroke vs. time curve when opening and closing the switch in accordance with an exemplary embodiment.

In an exemplary embodiment, the full stroke (e.g. 20 mm per drive) of the drives may not be necessary to travel in order for the contact system to provide the specified dielectric strength, but a distance much shorter (e.g. 10 mm per drive), which can be reached in an even shorter time, may suffice. This also provides certain safety in case of back-travel upon reaching the end-of-stroke position and damping phase of the actuators. FIG. 6 shows a stroke vs. time curve when opening and closing the switch in accordance with an exemplary embodiment. As shown in FIG. 6, a sufficient separation of the conducting elements 16 can be reached within 1 or 2 ms, for example.

As shown in FIG. 2, each terminal 8, 9 carries a contact plate 32 forming a contact surface 33 contacting the conducting elements 16 when the switch is in its first position. The contact plates 32 are mounted to the terminals 8, 9 in axially displaceable manner, with springs 20 elastically urging the contact surface 33 against the conducting elements, thereby compressing the conducting elements 16 in their aligned state for better conduction. In the exemplary embodiment of FIG. 2, helical compression springs 20 are used for this purpose, but other types of spring members can be used as well. Also, even though it is advantageous if there is at least one spring member in each terminal 8, 9, a compression force for the aligned conducting elements 16 can also be generated by means of a spring member(s) in only one of the terminals 8, 9.

Figure 3:
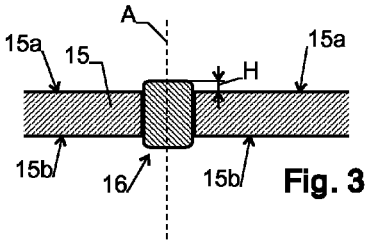
FIG. 3 shows a sectional view of a first carrier with a conducting element in accordance with an exemplary embodiment.

FIG. 3 shows a sectional view of a first carrier with a conducting element in accordance with an exemplary embodiment. FIG. 3 illustrates a sectional view of a single conducting element 16 in its carrier 15. As shown in FIG. 3, the conducting element axially projects by a height H over both axial surfaces 15*a*, 15*b* of carrier 15. In other words, the axial extension (i.e. the extension along axial direction A) of conducting element 16 exceeds the axial extension of carrier 15 that surrounds it. In an exemplary embodiment, the axial extension of carrier 15 at the location of conducting element 16 can be at least 10% less than the axial extension of conducting element 16.

Conducting element 16 can include an aluminium body with silver coating.

In the exemplary embodiment of FIG. 3, conducting element 16 is fixedly connected to carrier 15, e.g. by means of a glue.

Figure 4:
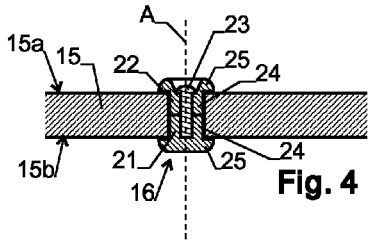
FIG. 4 shows a second embodiment of a second carrier and a conducting element in accordance with an exemplary embodiment.

FIG. 4 shows a second embodiment of a second carrier and a conducting element in accordance with an exemplary embodiment. As shown in FIG. 4, a contact element 16 includes a first section 21 and a second section 22 connected to each other, e.g. by means of a screw 23. Each section 21, 22 includes a shaft 24 and a head 25, with the head having larger diameter than the shaft. The two shafts 24 extend axially through an opening 26 of carrier 15 and the heads rest against the surfaces 15*a*, 15*b* of carrier 15. The distance between the two heads 25 is slightly larger than the axial extension of carrier 15, such that conducting element 16 is movable in axial direction A in respect to carrier 15 for the reasons described above.

In the exemplary embodiment of FIG. 4, a screw was used for connecting the two sections 21, 22. Alternatively, a rivet can be used as well. In yet a further alternative, one of the sections 21, 22 can be designed as a male section having a pin introduced into an opening of the other, female section for forming a press-fit or shrivel-fit connector.

As mentioned above, the contact surfaces 33 of the conducting plates 32 should be urged against the conducting elements 16 in their aligned state for better conduction. However, in the exemplary embodiments of the present disclosure, this can lead to comparatively high tangential forces while the contact elements 16 are being aligned, which can damage the surfaces and/or coatings of the components.

Figure 10:
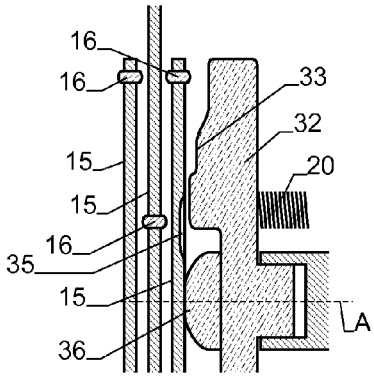
FIG. 10 shows a switch in an open state in accordance with an exemplary embodiment.
Figure 11:
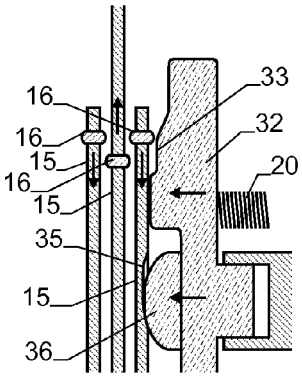
FIG. 11 shows the switch of FIG. 10 while closing in accordance with an exemplary embodiment.
Figure 12:
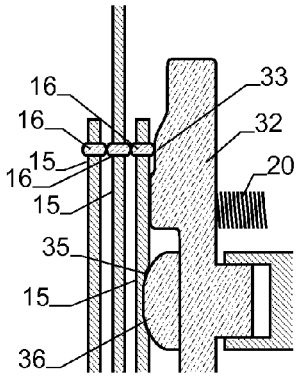
FIG. 12 shows the switch of FIG. 10 in its closed state in accordance with an exemplary embodiment.

FIGS. 10-12 show various states of switch in accordance with an exemplary embodiment. This switch reduces or eliminates the alignment problems. In this exemplary embodiment, the switch is structured to decrease the distance between the contact surfaces 33 in axial direction A while the switch is being closed. To achieve this, in the embodiment shown in FIGS. 10-12 at least one of the outmost insulating carriers 15 is designed as a cam plate having a recess 35, and contact surface 33 is connected to a cam follower 36. When the switch is open, recess 35 and cam follower 36 do not align and cam follower 36 abuts against a flat section of the cam plate. In this state, contact surface 33 is at an axial distance from its adjacent contact elements 16. When the switch closes, cam follower 36 aligns with recess 35, which causes contact plate 32 to move axially towards the carriers 15, thus decreasing the axial distance between contact surface 33 and its adjacent contact elements 16. Hence, the impact between contact surface 33 and conducting element 16 is primarily in axial direction A, and shearing forces on the surfaces of the contact elements 16 and on the contact surfaces 33 are reduced or avoided. Only when the switch is basically fully closed, the contact surfaces 33 come into contact with the contact elements 16 and compress them.

Figure 5:
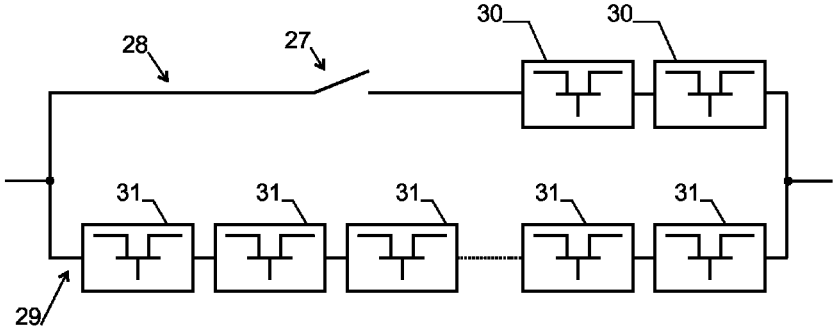
FIG. 5 shows an application of the switch in accordance with an exemplary embodiment.

FIG. 5 shows an application of the switch in accordance with an exemplary embodiment. FIG. 5 illustrates an application of the exemplary switch 27 of the present disclosure in a high voltage circuit breaker. This circuit breaker includes a primary electrical branch 28 and a secondary electrical branch 29 arranged parallel to each other. At least one solid state breaker 30 is arranged in primary branch 28 and a plurality of solid state breakers 31 is arranged in series in secondary branch 29. The number of solid state breakers 31 in the secondary branch 29 is much larger than the number of solid state breakers 30 in the primary branch 28.

When the circuit breaker is in its closed current-conducting state, all solid state breakers are conducting and switch 27 is closed. The current substantially bypasses secondary branch 29, because the voltage drop in primary branch 28 is much smaller. Hence, for nominal currents, the losses in the circuit breaker are comparatively small.

When the current is to be interrupted, in a first step the solid state breaker(s) 30 in primary branch 28 are opened, which causes the current in primary branch 28 to drop to a small residual value that is then interrupted by opening switch 27. Now, the whole current has been commuted to secondary branch 29. In a next step, the solid state breakers 31 in secondary branch 29 are opened.

Hence, in the opened state of the circuit breaker of FIG. 5, switch 27 carries the whole voltage drop in the secondary branch, thereby protecting the solid state breaker(s) 30 of primary branch 28 from dielectric breakdown.

The switch described above is well suited as the switch 27 for such an application because of its fast switching time and its large dielectric strength.

REFERENCE NUMBERS

1: housing
2: space
3, 4: tube sections
5: housing section
6, 7: support insulators
8, 9: terminals
10, 11: caps, flanges
12: switching arrangement
13*a*, 13*b*, 13*c*: first set of contact elements
14*a*, 14*b*, 14*c*: second set of contact elements
15: insulating carrier
15*a*, 15*b*: axial surfaces of insulating carrier
16, 16': conducting elements
17: actuator rods
18: contact plate
19: contact surface
20: springs
21, 22: first and second sections of contact element
23: screw
24, 25: shaft and head
26: opening
27: switch
28, 29: primary and secondary electrical branch
30, 31: semiconductor breakers
32: contact plate
33: contact surface
34: conducting path
35: recess
36: cam follower

What is claimed is:

1. A high or medium voltage switch comprising:

a first and a second terminal;

a first and a second set of contact elements arranged between the first and the second terminal; and at least a first drive adapted to mutually displace the sets of contact elements along a displacement direction, wherein each contact element comprises an insulating carrier carrying at least one conducting element, wherein in a first mutual position of said contact elements the at least one conducting element of each contact element forms at least one conducting path in an axial direction between said first and said second terminals in a direction transversally to said displacement direction, and wherein in a second mutual position of said contact elements the at least one conducting element of each contact element are mutually displaced and do not form said conducting path, and wherein said first and second contact elements are encapsulated in a fluid-tight housing and wherein said fluid-tight housing includes an electrically insulating fluid surrounding said contact elements, and wherein each terminal forms a contact surface for contacting the conducting elements, and at least one terminal includes a spring member elastically urging the contact surface of the terminal against the conducting elements.

2. The switch of claim 1, wherein the insulating fluid is a gas under a pressure exceeding 1 atm.

3. The switch of claim 2, wherein said gas comprises at least one of $SF_6$, air, and fluoroketone.

4. The switch of claim 3, wherein the fluoroketone includes at least one of C5-perfluoroketone and C6-perfluoroketone.

5. The switch of claim 1, wherein said fluid includes an oil or a two-phase dielectric medium.

6. The switch of claim 5, wherein the two-phase dielectric medium includes a fluoroketone.

7. The switch of claim 6, wherein the fluoroketone includes at least one of C5-perfluoroketone and a C6-perfluoroketone.

8. The switch of claim 1, wherein said switch is structured to decrease the distance of said contact surfaces in said axial direction upon closing the switch.

9. The switch of claim 1, wherein at least one of said carriers is structured as a cam plate having a recess, and wherein the contact surface adjacent to said cam plate is connected to a cam follower abutting against said cam plate, wherein, when the switch closes, said cam follower aligns with said recess.

10. The switch of claim 1, comprising:

a second drive in addition to said first drive, with said first drive connected to said first set and said second drive connected to said second set, and with said first and second drives being adapted to simultaneously move said first and second set, respectively, in opposite directions.

11. The switch of claim 1, wherein said housing comprises:

a first tube section ending in a first support insulator and in a second support insulator at opposite sides with the first terminal extending through the first support insulator and the second terminal extending through the second support insulator, and a second tube section, arranged substantially perpendicular to said first tube section.

12. The switch of claim 1, comprising:

a second drive in addition to said first drive, with said first drive connected to said first set and said second drive connected to said second set, and with said first and second drives being adapted to simultaneously move said first and second set, respectively, in opposite directions, wherein said housing comprises:

a first tube section ending in a first support insulator and in a second support insulator at opposite sides with the first terminal extending through the first support insulator and the second terminal extending through the second support insulator, and a second tube section, arranged substantially perpendicular to said first tube section.

13. The switch of claim 12, wherein said first drive and said second drive are arranged in opposite end regions of said second tube section, and wherein said contact elements are arranged at an intersection region of said first and second tube sections.

14. The switch of claim 1, wherein said drive or said drives is arranged within said housing.

15. The switch of claim 2, wherein each conducting element extends across a respective carrier carrying the conducting element and wherein an extension of the conducting element along the axial direction exceeds an extension of the carrier in the axial direction.

16. The switch of claim 3, wherein each conducting element extends across a respective carrier carrying the conducting element and wherein an extension of the conducting element along the axial direction exceeds an extension of the carrier in the axial direction.

17. The switch of claim 4, wherein each conducting element extends across a respective carrier carrying the conducting element and wherein an extension of the conducting element along the axial direction exceeds an extension of the carrier in the axial direction.

18. The switch of claim 5, wherein each conducting element extends across a respective carrier carrying the conducting element and wherein an extension of the conducting element along the axial direction exceeds an extension of the carrier in the axial direction.

19. The switch of claim 6, wherein each conducting element extends across a respective carrier carrying the conducting element and wherein an extension of the conducting element along the axial direction exceeds an extension of the carrier in the axial direction.

20. The switch of claim 7, wherein each conducting element extends across a respective carrier carrying the conducting element and wherein an extension of the conducting element along the axial direction exceeds an extension of the carrier in the axial direction.

21. The switch of claim 15, wherein the conducting element axially projects over two opposite surfaces of the respective carrier.

22. The switch of claim 15, wherein an axial extention of the carrier at a location of a conducting element is at least 10% less than an axial extension of the conducting element.

23. The switch of claim 1, wherein each conducting element is movable in an axial direction and tiltable about a tilt axis perpendicular to the axial direction and the direction of displacement.

24. A current breaker including a switch including a first and a second terminal, a first and a second set of contact elements arranged between the first and the second terminal, and at least a first drive adapted to mutually displace the sets of contact elements along a displacement direction, wherein each contact element comprises an insulating carrier carrying at least one conducting element, wherein in a first mutual position of said contact elements the at least one conducting element of each contact element forms at least one conducting path in an axial direction between said first and said second terminals in a direction transversally to said displacement direction, and wherein in a second mutual position of said contact elements the at least one conducting element of each contact element are mutually displaced and do not form said conducting path, and wherein said first and second contact elements are encapsulated in a fluid-tight housing and wherein said fluid-tight housing includes an electrically insulating fluid surrounding said contact elements, each terminal forms a contact surface for contacting the conducting elements, and at least one terminal includes a spring member elastically urging the contact surface of the terminal against the conducting elements, said current breaker comprising:

a primary electrical branch and a secondary electrical branch in parallel;

at least one solid state breaker arranged in the primary electrical branch; and a plurality of solid state breakers arranged in series in the secondary electrical branch, wherein a number of solid state breakers in the secondary electrical branch is larger than a number of solid state breakers in the primary electrical branch, and wherein said switch is arranged in said primary electrical branch in series to said solid state breaker of said electrical primary branch.

25. The current breaker of claim 24, comprising:

a second drive in addition to said first drive, with said first drive connected to said first set and said second drive connected to said second set, and with said first and second drives being adapted to simultaneously move said first and second set, respectively, in opposite directions.

* * * * *